US009670749B2

(12) United States Patent
Pessin et al.

(10) Patent No.: US 9,670,749 B2
(45) Date of Patent: Jun. 6, 2017

(54) INTEGRATED PUMP ASSEMBLY FOR WELL COMPLETION

(75) Inventors: Jean-Louis Pessin, Houston, TX (US); Laurent Coquilleau, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 728 days.

(21) Appl. No.: 11/560,258

(22) Filed: Nov. 15, 2006

(65) Prior Publication Data

US 2007/0295509 A1 Dec. 27, 2007

Related U.S. Application Data

(60) Provisional application No. 60/805,693, filed on Jun. 23, 2006.

(51) Int. Cl.
*E21B 33/14* (2006.01)
*E21B 21/01* (2006.01)

(52) U.S. Cl.
CPC ..... *E21B 33/14* (2013.01); *E21B 21/01* (2013.01)

(58) Field of Classification Search
CPC . E21B 7/12; E21B 33/14; E21B 21/01; F04B 9/08; F04B 9/10; F04B 9/113; F04B 9/115; F04B 9/117
USPC ..... 175/8, 207, 217; 166/352, 360; 417/199.1, 382, 390, 900
See application file for complete search history.

(56) References Cited

U.S. PATENT DOCUMENTS

| | | | | |
|---|---|---|---|---|
| 2,194,054 A * | 3/1940 | Peterson | 417/247 |
| 2,282,597 A * | 5/1942 | Archer | 417/362 |
| 3,435,906 A * | 4/1969 | Nicolson | 175/7 |
| 3,891,037 A * | 6/1975 | Well | B63C 11/40 173/152 |
| 3,976,148 A | 8/1976 | Maus et al. | |
| 4,178,142 A | 12/1979 | Schwing | |
| 4,191,513 A | 3/1980 | Schwing | |

(Continued)

FOREIGN PATENT DOCUMENTS

| | | |
|---|---|---|
| WO | 9925608 A1 | 5/1999 |
| WO | 03001062 A1 | 1/2003 |
| WO | 2005088131 A1 | 9/2005 |

OTHER PUBLICATIONS 56.0931MX—Office Action dated Oct. 14, 2011.

(Continued)

*Primary Examiner* — Shane Bomar
(74) *Attorney, Agent, or Firm* — Michael L. Flynn; Jody Lynn DeStefanis; Robin Nava

(57) ABSTRACT

An integrated pump assembly for both delivering mud and cement slurry to a borehole during a well completion operation. The pump assembly includes separate mud and cement pumps for maintaining isolation between mud and cement slurry during different stages of the operation. However, in order to obviate the need for a dedicated cement pump prime mover, the cement pump may be driven by the mud pump itself or a prime mover coupled to the mud pump. In the case of coupling the cement pump to the mud pump a hydraulic line may be employed such that hydraulically compatible mud and cement pumps may be more remotely positioned relative to one another if so required based on equipment blueprints for a given well completion facility to be located at a production site.

25 Claims, 6 Drawing Sheets

(56) References Cited

U.S. PATENT DOCUMENTS

| | | | | | |
|---|---|---|---|---|---|
| 4,341,508 | A | * | 7/1982 | Rambin, Jr. | 417/426 |
| 4,611,973 | A | * | 9/1986 | Birdwell | 417/342 |
| 4,634,352 | A | | 1/1987 | Austin | |
| 4,703,813 | A | * | 11/1987 | Sieler | 175/5 |
| 4,880,365 | A | | 11/1989 | Austin | |
| 4,899,832 | A | * | 2/1990 | Bierscheid, Jr. | 175/85 |
| 5,289,877 | A | | 3/1994 | Naegele | |
| 5,344,570 | A | * | 9/1994 | McLachlan et al. | 210/709 |
| 5,580,166 | A | | 12/1996 | Schmittchen | |
| 6,048,132 | A | | 4/2000 | Kupke et al. | |
| 6,048,135 | A | * | 4/2000 | Williford et al. | 405/196 |
| 6,056,071 | A | | 5/2000 | Scott et al. | |
| 6,228,153 | B1 | * | 5/2001 | Saitoh | 96/218 |
| 6,505,691 | B2 | | 1/2003 | Judge | |
| 6,904,982 | B2 | | 6/2005 | Judge | |
| 7,004,730 | B1 | | 2/2006 | Williams | |
| 7,096,948 | B2 | | 8/2006 | Mosing | |
| 2006/0196695 | A1 | * | 9/2006 | Giroux et al. | 175/57 |
| 2006/0239834 | A1 | * | 10/2006 | Larson | F04B 9/10 417/269 |
| 2008/0260545 | A1 | * | 10/2008 | Frokjaer et al. | 417/212 |
| 2016/0334300 | A1 | * | 11/2016 | Hilpert | E21B 47/1025 |

OTHER PUBLICATIONS

Office Action issued Sep. 6, 2013 for corresponding Chinese Patent Application No. 200780019895.1, Agent's English Translation provided, 11 pages total.

Foreign Agent's English translation of third office action issued Mar. 22, 2013 for corresponding Chinese Patent Application No. 200780019895.1, 12 pages.

Examination Report issued in India Patent Appl. No. 7088/chenp/2008 on Mar. 18, 2016; 2 pages.

* cited by examiner

INTEGRATED PUMP ASSEMBLY FOR WELL COMPLETION

CROSS-REFERENCE TO RELATED APPLICATION

This application claims priority under 35 U.S.C. §119(e) to U.S. Provisional Application Ser. No. 60/805,693, filed on Jun. 23, 2006, which is incorporated herein by reference.

BACKGROUND

Embodiments described relate to mud pumping and cement pumping equipment and applications for completion of hydrocarbon wells. In particular, embodiments of offshore hydrocarbon wells, techniques for their completion and completion equipment such as the noted pumping equipment are described.

BACKGROUND OF THE RELATED ART

Exploring, drilling, and completing hydrocarbon wells are generally complicated, time consuming and ultimately very expensive endeavors. This may be especially true in the case of certain drilling and completion operations where the configuration or environment of the operation or production site presents added challenges.

In the case of offshore, and certain other drilling operations, the operating environment may pose several natural challenges dramatically affecting the expense of operations. In the case of offshore drilling, measures are often taken to curtail expenses such as keeping equipment and space for equipment to a minimum. That is, for a given offshore operation, any increase in the amount or types of equipment required, as well as the necessary accommodations therefor, comes with a fairly dramatic increase in offshore set up and operating expenses. In certain circumstances expenses may be saved by limiting the equipment employed. However, even with certain sacrifices made in terms of equipment choices, available footspace remains at a premium in offshore operations.

Regardless of the premium on available footspace at an offshore platform, like most drilling rigs, an offshore drilling rig generally includes both a mud circulation assembly and a cementing assembly along with a host of other drilling equipment. These assemblies in particular, are alternatingly employed in completing an underground well and providing a casing therefor. That is, as a drill bit is advanced downward to form and extend a borehole below ground, the mud circulation assembly is employed to both provide fluid and remove debris with respect to a location near the advancing bit. Once the borehole has been drilled to the desired depth by the drill bit, mud circulation is temporarily stopped with the drill bit and associated drilling pipe brought back to the surface. A section of borehole casing may then be advanced down into the borehole. Once the borehole casing is properly positioned and the mud circulation terminated, the cementing assembly may be operated to pump a cement slurry through the borehole, securing the borehole casing in place. This process may then be repeated until a well of the desired depth has been completed. That is, further drilling, mud circulation, and advancing of additional borehole casing, may continue, periodically interrupted by subsequent cementing and securing of the casing as described.

In the above method of well completion two different types of fluid, mud and cement slurry, may be present within the borehole depending on what stage of the operation is in effect. However, these fluids serve entirely different purposes. The mud is circulated through the borehole with the purpose of lubricating, cooling, and furthering the advancement of the drill bit. On the other hand, cement is introduced to the borehole with the purpose of stabilizing the borehole casing in a secure and final position. Thus, the introduction of either of these fluids at the wrong time may be of dire consequence to the proper completion of the well. For example, the presence of no more than about 1%-3% mud at a location for cementing may prevent the cement slurry from setting and forming a proper bond between the borehole casing and the wall of the borehole at that location. Alternatively, cement contaminants within the mud during drilling may impede drilling and stop the advancement of borehole casing altogether. Either of these circumstances are likely to have severe consequences, perhaps requiring a shut down of the entire operation for re-drilling at a new location, likely at a cost of several hundred thousand dollars if not more.

Given the potential catastrophic consequences of cement slurry or mud contamination at the improper stage of well completion, the mud circulation assembly and the cementing assembly are separately maintained and isolated from one another on the rig. Thus, the mud circulation assembly, operating 90%-97% of the time during active drilling operations, is operated from one location on the rig with multiple high horsepower prime movers, pumps and other equipment. When the time for cementing approaches, mud circulation is terminated and from a separate cementing room of the rig, the above described cementing assembly is operated, employing its own comparatively lower horsepower prime movers, pumps, and associated equipment. While understandable in light of the potential consequences of contamination as described above, in the case of an offshore rig, this maintenance of entirely separate assemblies and associated equipment comes at a significant cost to already scarce footspace.

SUMMARY

A pump assembly is provided for delivering mud and cement slurry to a borehole. The pump assembly includes a prime mover coupled to a mud pump. A cement pump is coupled to one of the prime mover and the mud pump itself to deliver the cement slurry to the borehole.

DETAILED DESCRIPTION

Embodiments are described with reference to certain offshore hydrocarbon completion or production facilities such as a semi-submersible rig. However, other types of offshore production facilities including jack-up rigs, and barge rigs may employ embodiments described herein. Furthermore land based completion or production facilities may employ such embodiments. Regardless, embodiments described herein may be employed to reduce the total equipment required for a well completion operation, thereby providing savings in terms of capital cost, certain operational inefficiencies, footspace, and total equipment weight. As such, embodiments described herein may be especially of benefit for offshore operations.

Figure 1:
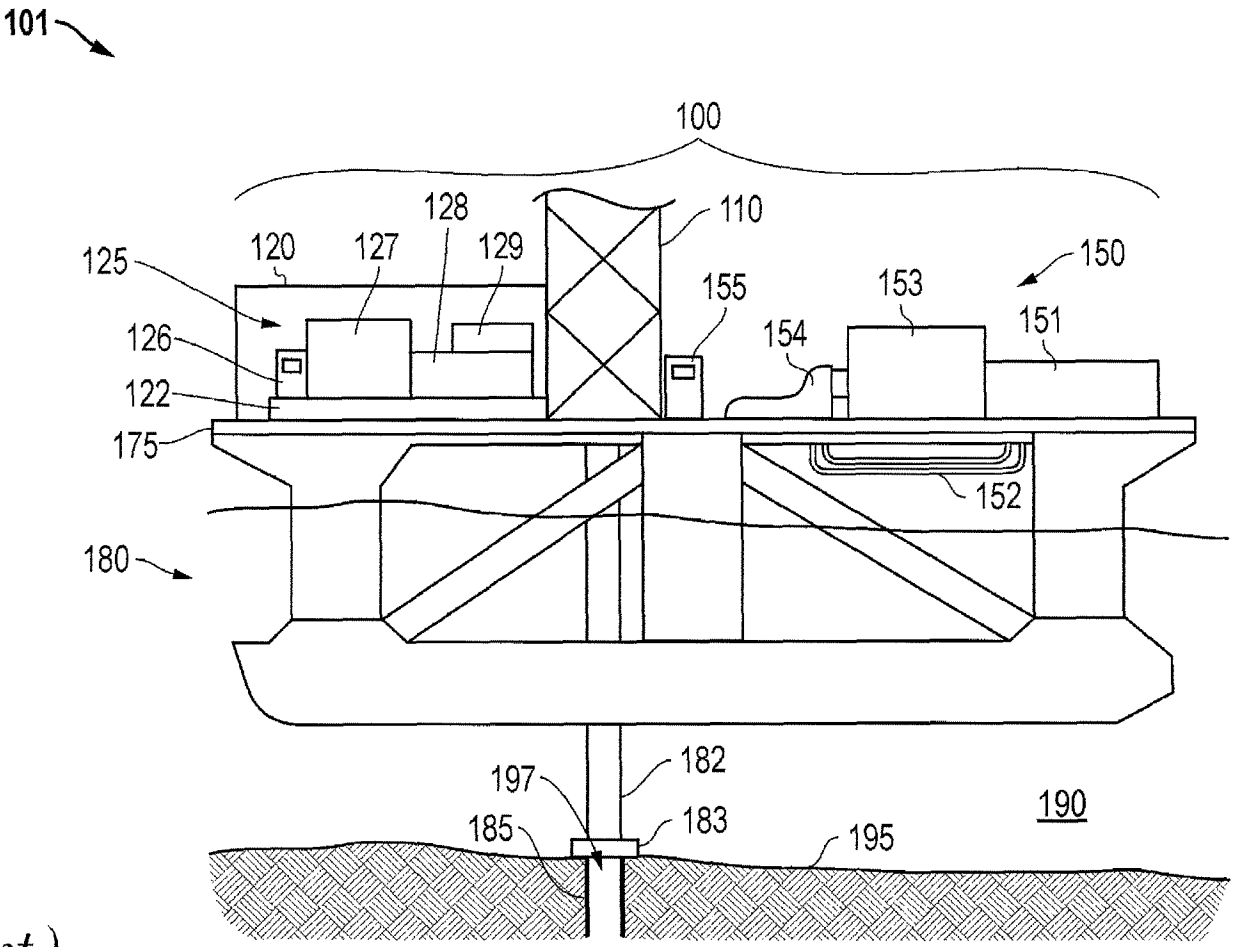
FIG. 1 (Prior Art)
FIG. 1 is a side view of a prior art pump assembly for mud pumping and cement pumping applications at a borehole.
Figure 2:
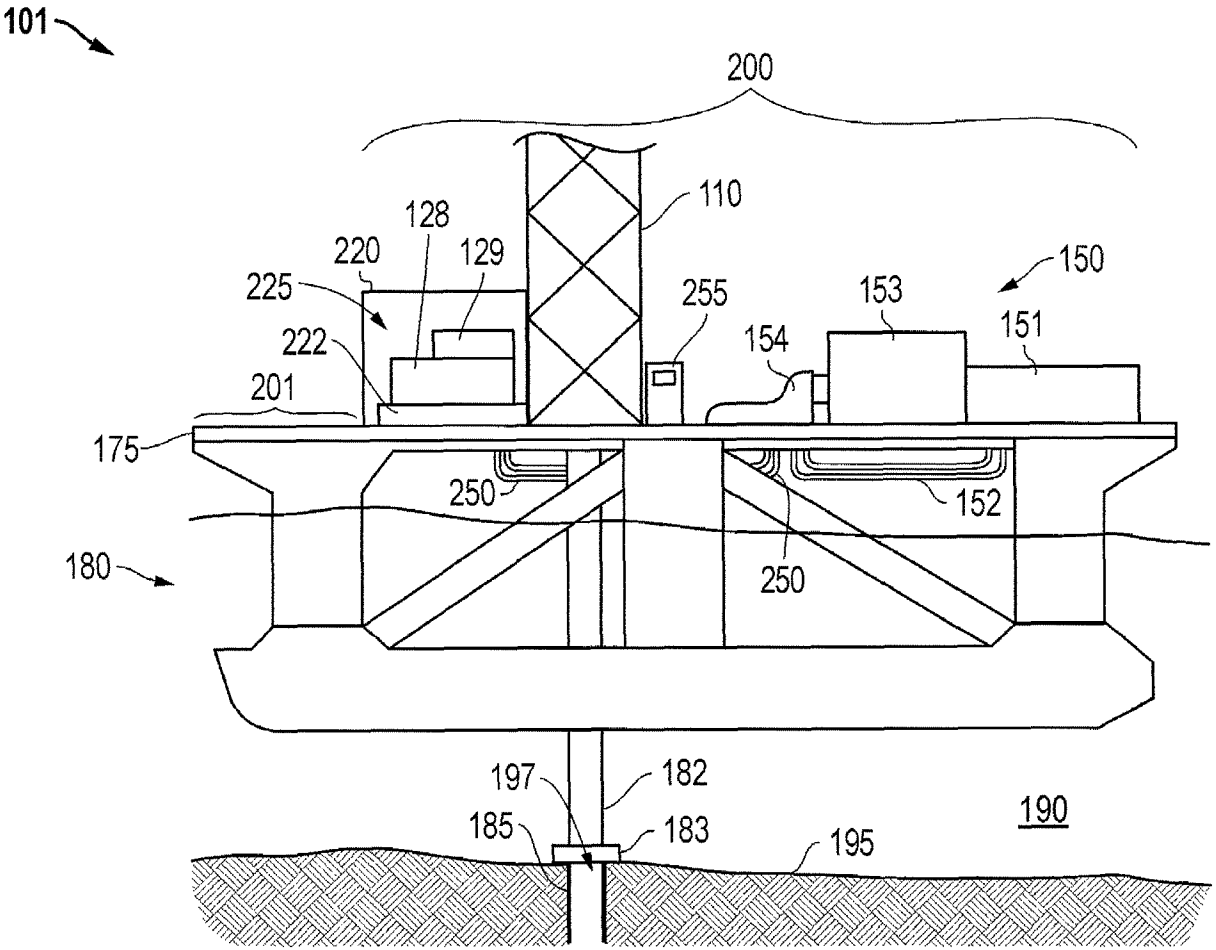
FIG. 2 is a side view of an embodiment of a pump assembly for mud pumping and cement pumping applications at the borehole of FIG. 1.

Referring now to FIGS. 1 and 2, a prior art employment of a pump assembly 100 including wholly separate cement pumping and mud pumping equipment 125, 150 may be viewed in light of a pump assembly 200 having integrated or coupled cement pumping and mud pumping equipment 225, 150. Due to the coupling of the cement pumping and the mud pumping equipment 225, 150, the pump assembly 200 of FIG. 2 may be smaller and lighter weight as compared to the pump assembly 100 of FIG. 1. Thus, significant footspace and weight may be saved at a production site as detailed further herein.

Space and weight savings as noted above may ultimately reduce operational costs and provide other advantages to a well completion operation. For example, as shown in FIGS. 1 and 2, the pump assemblies 100, 200 are provided to an offshore production site by way of a semi-submersible rig 101. As a matter of expense and practicality, significant space and weight restrictions inherently accompany such a rig 101 due to its offshore, semi-submersible nature. That is, unlike a terrestrial production site, equipment space is limited to the amount of footspace at the platform 175. Further, to ensure stability of a semi-submersible rig 101, fairly tight control over the weight of the rig 101 including all of its equipment may be exercised. Thus, the availability of a smaller and lighter weight pump assembly 200 as shown in the embodiment of FIG. 2 may be of significant benefit as detailed further below.

Continuing now with reference to FIG. 2, the semi-submersible rig 101 is shown accommodating the pump assembly 200 at the platform 175 as indicated above. Unlike the pump assembly 100 of FIG. 1, the pump assembly 200 of FIG. 2 includes cement pumping equipment 225 that is directly coupled to the mud pumping equipment 150 via hydraulic coupling lines 250. In particular, the hydraulic coupling lines 250 couple a cement pump 128 of the cement pumping equipment 225 to a mud pump 154 of the mud pumping equipment 150. This coupling allows the mud pump 154 to act as a prime mover for the cement pump 128.

Figure 3:
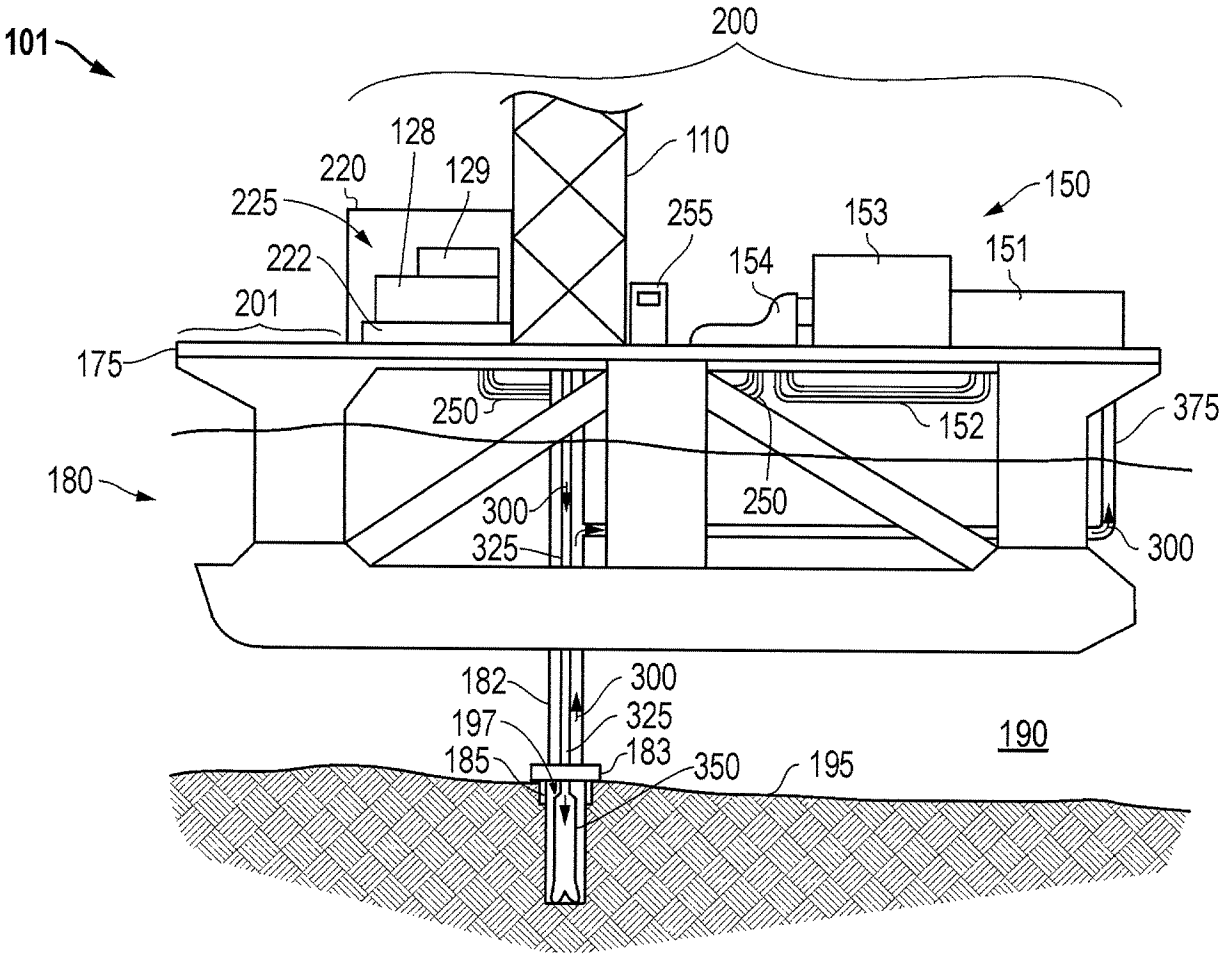
FIG. 3 is a side view of the pump assembly of FIG. 2 during a mud pumping application at the borehole of FIG. 1.
Figure 4:
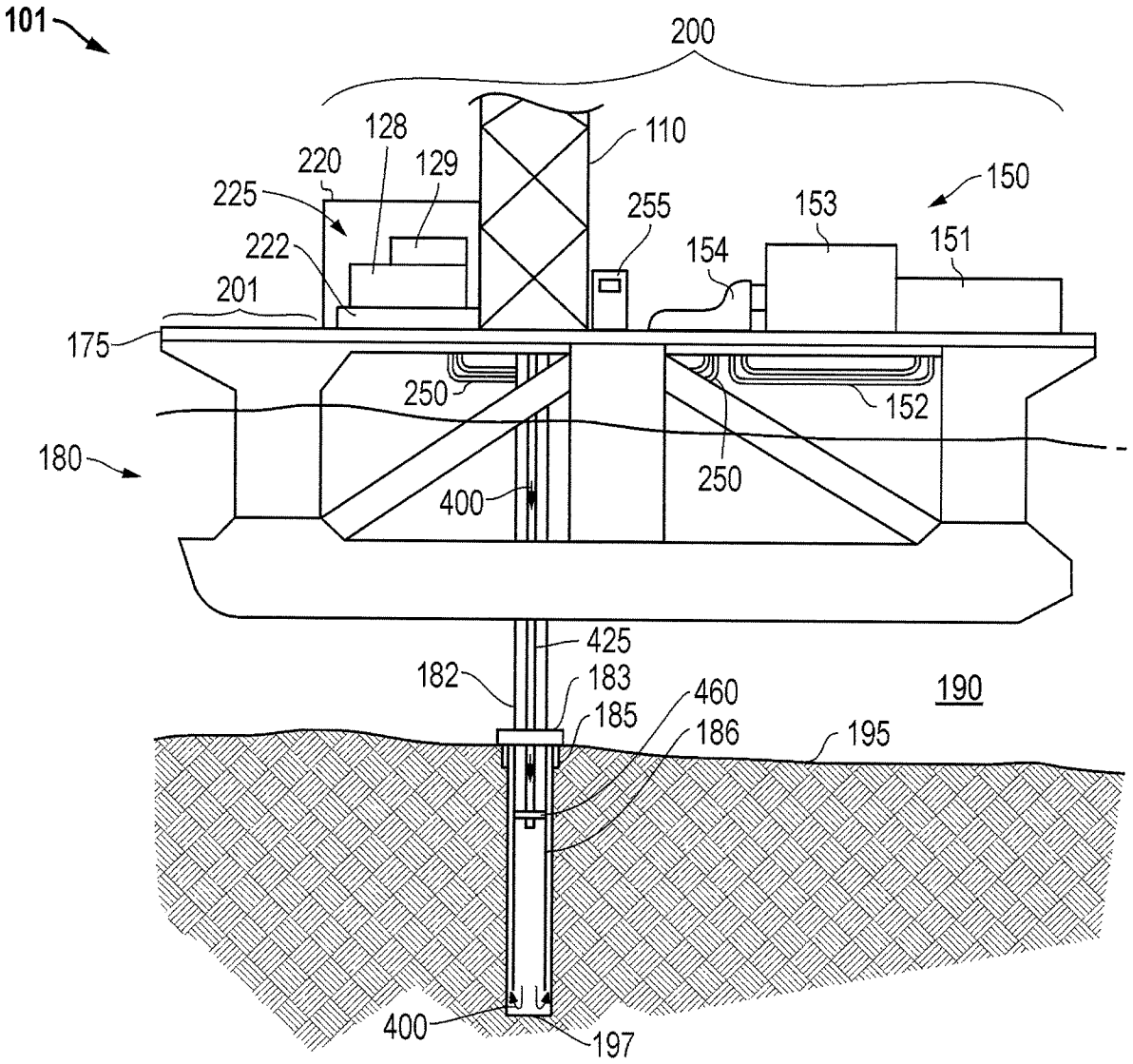
FIG. 4 is a side view of the pump assembly of FIG. 2 during a cement pumping application at the borehole of FIG. 1.

As shown in FIGS. 2-4, the hydraulic coupling lines 250 circulate fluid to and from the cement pump 128 in order to reciprocate a plunger mechanism thereat by conventional means, thereby driving the cement pump 128. The hydraulic fluid driven through the hydraulic coupling lines 250 may be a hydraulic oil or even the same mud 300 employed during a drilling application as described below. More preferably, however, water may be employed, in part because this may help further clean out of the mud pump 154 following its preceding pumping of mud 300 as detailed below. Regardless, the fluid employed is directed at the plunger mechanism but not at other portions of the cement pump 128 whereat cement slurry 400 may be found. Thus, contamination of the cement slurry 400 with the selected hydraulic fluid may be avoided.

As a result of the above-described coupling, the cement pumping equipment 225 of the embodiment shown does not require a cement prime mover 127 as does the prior art embodiment of FIG. 1. Given that conventional cement pumping equipment 125 is likely to include multiple pumps 128 and prime movers 127, the elimination of such a cement prime mover 127 may be of considerable significance. As described further below, a reduction of between about 40% and about 65% in the amount of footspace required to accommodate the cement pumping equipment 225 may be achieved. An increase in available footspace 201 may be seen as a result.

In addition to the benefit of the above noted increase in available footspace 201, other advantages may be obtained from eliminating the cement prime mover 127 of FIG. 1 as shown in the embodiment of FIG. 2. For example, a conventional cement prime mover 127 may weigh in excess of about 12,000 pounds. Therefore, removal of each cement prime mover not only saves space, but also provides a significant reduction in equipment weight that must be supported by the submersible portion 180 of the rig 101. Thus, a degree of control may be provided to the submersible portion 180 resulting in added stability to the partially floating rig 101 on the whole.

Continuing with reference to FIG. 2, with added reference to FIG. 1, further benefit may be realized from coupling the cement pumping equipment 225 to the mud pumping equipment 150 as indicated above. That is, as shown in FIG. 1, a cement pumping control unit 126 is provided for controlling a cementing application as described further below. A separate mud pumping control unit 155 is similarly provided for controlling a mud pumping application (also detailed below). However, while not required, the embodiment of FIG. 2 reveals that a single completion control unit 255 may be provided for directing both mud pumping and cementing portions of a well completion operation. Thus, a single operator may direct well completion operations from a single location on the rig 101, thus efficiently streamlining operator interfacing with the pump assembly 200. Furthermore, an added degree of footspace and weight may be saved by elimination of yet another piece of equipment at the platform 175 (i.e. the eliminated cement pumping control unit 126).

Continuing with reference to FIG. 2, the integration or coupling of the cement pumping equipment 225 to the mud pumping equipment 150 is further detailed. Of note is the fact that while the equipment 225, 150 is coupled in the embodiment of FIG. 2, this integration is achieved in a manner that maintains isolation of mud 300 and cement slurry 400 from one another during well completion applications (see FIGS. 3 and 4). Thus, the above described benefits such as increased available footspace 201, reduced equipment weight, and others are achieved without sacrificing the integrity of such applications.

As shown in FIG. 2, cementing equipment 225 is provided in a cementing room 220 on the platform 175. In the embodiment shown, the cementing equipment 225 includes a cement pump 128 and a cement mixer 129 atop a skid base 222. However, as indicated, the requirement of a separate cement prime mover 127 and cement control unit 126 as shown in FIG. 1 has been eliminated. Thus, the size of the skid base 222 and indeed, the entire cementing room 220, has been significantly reduced, from the skid base 122 and cementing room 120 of FIG. 1, leaving added available footspace 201 as shown in the embodiment of FIG. 2.

Conventional cementing equipment 125 atop a skid base 122, as shown in FIG. 1, may extend to about 30 feet in length. However, in embodiments described herein, the cementing equipment 225 and the skid base 222 may extend only from about 5 feet to about 15 feet in its largest dimension. That is, as alluded to above, a reduction of between about 40% and about 65% of the space required for equipment may be achieved with elimination of the cement prime mover 127 and the cement control unit 126 of FIG. 1 along with associated soundproofing and other materials. The effect of such elimination may be amplified by the fact that the cementing equipment may have more than one cement pump and thus, embodiments described herein may include the elimination of more than one corresponding cement prime mover 127.

Continuing with reference to FIGS. 1 and 2, in order to eliminate the requirement of the more massive cement prime mover 127, hydraulic coupling lines 250 are provided to couple the cement pump 128 and the mud pump 154. In an embodiment where the pumps 128, 154 are hydraulically compatible, the above noted hydraulic coupling lines 250 therebetween may allow both pumps 128, 154 to be ultimately driven by the same prime mover 153. In the embodiment shown in FIG. 2, the mud pump 154 is of greater horsepower than the cement pump 128, thus ensuring adequate supply of power for mud pumping or cement pumping as described with reference to FIGS. 3 and 4 below. Additionally, while a single cement pump 128 is shown coupled to a single mud pump 154 in the embodiment of FIG. 2, in an alternate embodiment multiple cement pumps 128 may be provided as part of the cement equipment 225 coupled to a single mud pump or multiple mud pumps 154 of the mud pumping equipment 150.

Use of hydraulic coupling lines 250 to couple the pumps 128, 154 as indicated above also allows the cementing equipment 225 to be somewhat remotely located relative to the prime mover 153. That is, the inherent power transfer capacity of conventional hydraulics are such that use of hydraulic coupling lines 250 such as those shown would allow placement of the hydraulically compatible pumps 128, 154 at about any location on a conventional offshore rig 101 relative to one another. Thus blueprints for configurations of conventional rigs with relatively unaffiliated pumping equipment need not be drastically modified in order to accommodate embodiments described herein that employ coupled pumping equipment as indicated.

Continuing with reference to FIG. 2, and with added reference to FIG. 1, the above described mud pump 154 is shown as part of an assembly of mud pump equipment 150 that also includes a prime mover 153 and a mud tank 151. The mud pump 154 is directly coupled to the prime mover 153 which may be a large conventional diesel, electric or other engine. The mud pump 154 is also coupled to the mud tank 151 by circulation lines 152. As described below, these circulation lines provide a fluid flow of mud and water or other liquids into and out of the tank 151 and a forming borehole 197.

Operation of the pump assembly 200 is directed from a single unitary completion control unit 255 as opposed to multiple control units disbursed throughout the rig 101. In addition to directing mud pumping operations, the completion control unit 255 is configured for coupling to cement pumping equipment 225 for directing a cementing application as described further below. In the embodiment shown, a tower 110 interfaces the platform 175 of the rig 101 at a central location. The tower 110 may be employed to support a variety of tools for forming or accessing a borehole 197 therebelow. Such access may be for well completion as detailed further below, for well production, or a variety of well access applications.

The rig 101 includes a submersible portion 180 configured to support the platform 175 above water 190 at all times. The submersible portion 180 or other parts of the rig 101 may be anchored, tethered, or otherwise secured to the floor 195 of the ocean or other body of water 190. The effectiveness of anchoring the submersible portion 180 in particular may be improved to a degree by elimination of substantially massive equipment there-above such as any cement prime movers 127 (see FIG. 1). As shown in FIG. 2, the rig 101 may display the benefit of improved stability as indicated while including the additional benefit of increased available footspace 201. With a stably positioned and secured rig 101 in place at the production site, a borehole 197 may be started with a borehole casing 185 advanced thereinto. Well completion operations may then ensue as described in further detail below.

Referring now to FIG. 3, a mud pumping application is described in which an embodiment of the above described pump assembly 200 is employed. In the embodiment shown, the mud pump 154 of the pump assembly 200 may be a 1,500 to 2,500 Hp pump for directing mud 300 down a drilling pipe 325 within the marine riser pipe 182. At this same time, a bit 350 is rotated to grind and cut away pieces of rock and earth cuttings, increasing the depth of the borehole 197. In the embodiment shown, mud 300 may be directed toward the bit 350 by the mud pump 154 at up to about 5,000 PSI as the borehole 197 is formed.

Continuing with reference to FIG. 3, the mud 300 is carried by the drilling pipe 325 as indicated and exits the bit 350 at the bottom of the borehole 197. In this manner, lubrication and a degree of thermal regulation may be provided to the bit 350 as it grinds and cuts away rock and other earth. Furthermore, the mud 300 is delivered to the borehole with enough pressure to force such rock and earth cuttings back up the marine riser pipe 182 adjacent the drilling pipe 325. In this manner, the mud 300 and cuttings may be removed via a return line 375. In the embodiment shown, the return line 375 empties into the mud tank 151. A shaker or other sifting mechanism may be employed to ensure that larger cuttings are separated from the returning mud 300. Thus, the mud 300 may be re-circulated back to the mud pump 154 via circulation lines 152 and ultimately back into the drilling pipe 325 for use in continued drilling as indicated above.

As described above, drilling while employing the circulating mud 300 provides lubrication and a degree of cooling to the grinding bit 350. The circulation of the mud 300 also allows for the removal of cuttings and debris as the borehole 197 extends deeper below the floor 195. In the embodiment shown, such mud circulation and drilling are directed from a completion control unit 255. Once a given depth of the borehole has been reached, the completion control unit 255 may be employed to cease the indicated circulation of mud 300 and retract the drilling pipe 325. Thus, cementing of a section of borehole casing 185 may ensue. As described with added reference to FIG. 4 below, the completion control unit 255 may also be used in directing the subsequent cementing application.

Referring now to FIG. 4, the completion control unit 255 may direct cementing as indicated. With the borehole 197 substantially free of mud 300 (see FIG. 3), a cementing pipe 425 may be advanced toward the terminal end of an advanced borehole casing section 186 below the seafloor wellhead assembly 183 and the marine riser pipe 182. As shown in FIG. 4, a plug 460 may be positioned at a terminal end of an advanced borehole casing section 186 for sealing it off as has been previously done with the section of borehole casing 185 thereabove. In this manner, the cementing pipe 425 piercing the plug 460 may be employed to carry a cement slurry 400 downhole thereof. Thus, the cement slurry 400 may be forced back uphole adjacent the advanced borehole casing section 186 for stabilizing and securing it in place.

In one embodiment the above-described cement pump 128 operates at between about 200 Hp and about 800 Hp, preferably at about 300 Hp as supplied by the mud pump 154 in order to direct the cement slurry 400 as indicated. Between about 1,500 and about 15,000 PSI may be generated in this manner for driving the cement slurry 400 as shown. Additionally, a cement mixer 129 may be driven at low pressure in advance of, or during, the driving of the cement slurry 400 into the borehole 197. In fact, in one embodiment, the cement mixer 129 may be driven by the cement pump 128. Again, in such an embodiment, powering of the cement pump 128 for such tasks is achieved via the coupling of the cement pump 128 to the mud pump 154 through the hydraulic coupling lines 250.

As indicated above, the same completion control unit 255 that is employed in directing mud circulation may be employed in directing the described cementing. Thus, some equipment space in the cementing room 220 may be saved. However, even more significantly, the configuration of the pump assembly 200 itself is such that the described cementing application may proceed without use of a dedicated cementing prime mover such as that of the prior art (see the prime mover 127 of FIG. 1). Therefore, further increase in the size of the available footspace 201 may be obtained at the platform 201.

Figure 5:
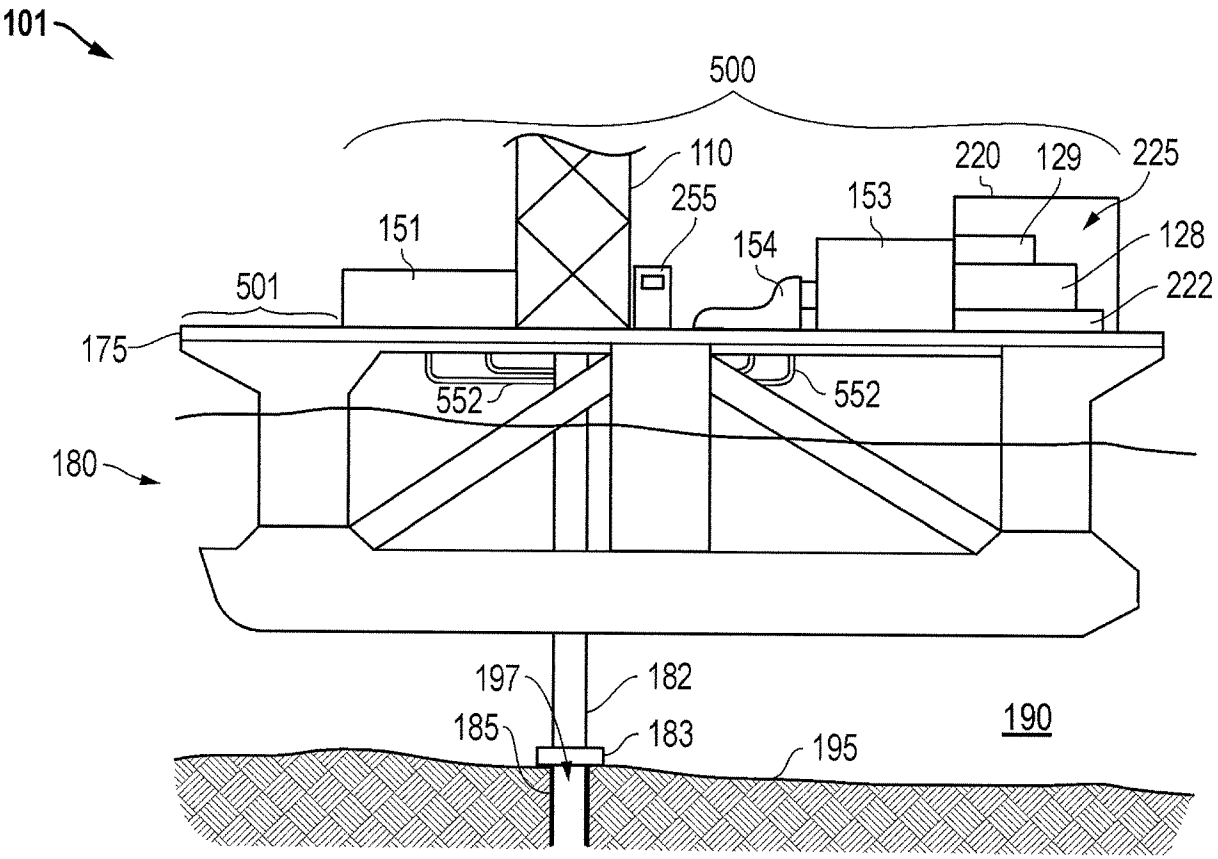
FIG. 5 is a side view of an alternative embodiment of a pump assembly for mud pumping and cement pumping applications at the borehole of FIG. 1.

As indicated above, removal of the dedicated cementing prime mover may be achieved by driving the cement pump 128 with the mud pump 154. As shown in FIG. 4, this may be achieved by coupling the pumps 128, 154 with hydraulic coupling lines 250 where the pumps 128, 154 are hydraulically compatible. Alternatively, however, as shown in FIG. 5, the cement pump 128 may be integral with the prime mover 153 in order to eliminate the need for a dedicated cementing prime mover. That is, rather than run lengthy hydraulic coupling lines 250 between the pumps 128, 154, the cement pump 128 may be driven directly by the prime mover 153. In fact, in the embodiment shown in FIG. 5, the entire cementing room 220 is positioned adjacent the prime mover 153 with the mud tank 151 repositioned opposite the tower 110. This may be achieved by reconfiguring circulation lines 552 as shown. Regardless, added available footspace 501 is provided due to the lack of a requirement for a dedicated cementing prime mover.

In the above described embodiments, mud pumping equipment 150 and cement pumping equipment 225 have been linked together for the sake of streamlining well completion and reducing the total equipment required for the process. However, this is done in such a manner as to maintain isolation of mud 300 from cement slurry 400. That is, rather than employ a single pump such as the mud pump 154 for directly driving both the circulation of mud 300 and the driving of a cement slurry 400, a separate pump such as the cement pump 128 is retained as part of the pump assembly 200. In this manner, the circulation of mud 300 remains physically isolated from the driving of the cement slurry 400. Thus, the risk of contamination with cement slurry 400 during drilling or with mud 300 during cementing is not increased by employment of embodiments of the pump assembly 200 as described herein. Nevertheless, a significant amount of equipment (e.g. the cement prime mover 127 of FIG. 1) may be eliminated by coupling the cement pump 128 directly to one of the mud pump 154 and/or its prime mover 153.

Figure 6:
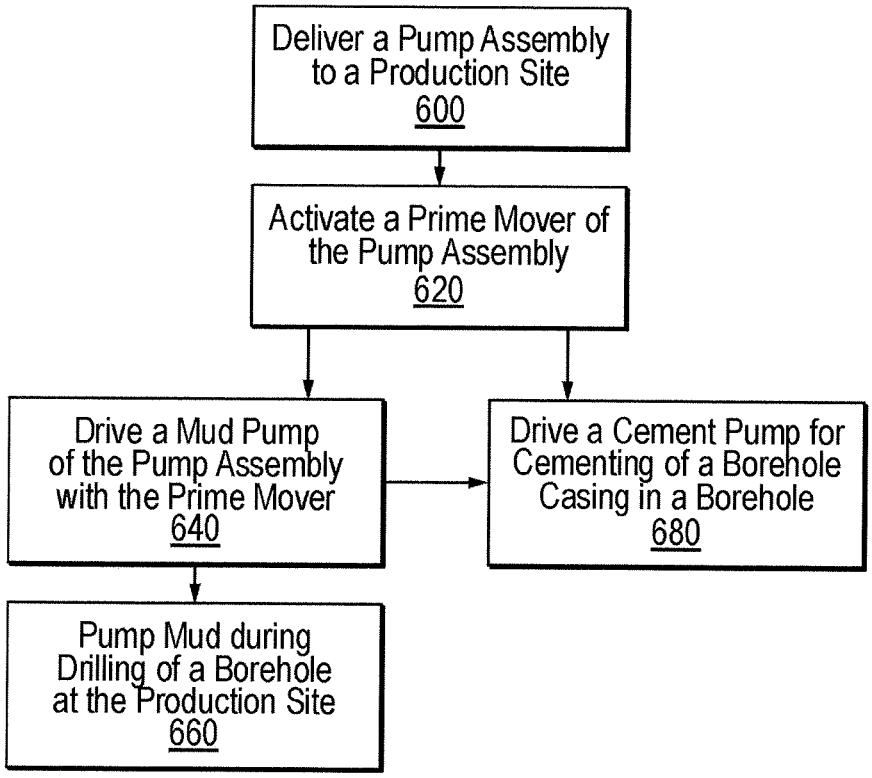
FIG. 6 is a flow chart summarizing an embodiment of employing a pump assembly for mud pumping and cement pumping at a borehole.

Referring now to FIG. 6, with added reference to FIGS. 1-5, a method of well completion is summarized in the form of a flow-chart. The method summarized may employ embodiments of pump assemblies 200, 500 described above for drilling and cementing applications of a well completion operation. For example, as indicated at 600 a pump assembly may be delivered to a production site where a prime mover of the pump assembly is activated (see 620). As indicated at 640 and 660, activation of the prime mover may drive a mud pump of the pump assembly for pumping mud during a drilling application (see FIG. 3).

Unlike a conventional pump assembly as described above with reference to FIG. 1, a cement pump embodiment for cementing of a borehole casing following drilling may be uniquely driven. That is, as indicated at 680 a cement pump of the pump assembly may be driven by the above noted mud pump (see FIGS. 2-4). Alternatively, as also apparent with reference to 680, the cement pump may be driven by the same prime mover as the mud pump (see FIG. 5). Regardless, the need for a separate cement pump prime mover dedicated to driving the cement pump alone is eliminated. As described above, this is achieved through integration or coupling of the cement pump to certain mud pump equipment in a manner that preserves isolation of mud from cement slurry during operation.

As noted, embodiments of pump assemblies described herein for use in a well completion operation are employed in a manner that avoids the potential catastrophic consequences of cement slurry or mud contamination at the improper stage of well completion. The pump assemblies described retain substantially isolated mud circulation and cement slurry applications while including strategically coupled mud pumping equipment and cement pumping equipment. Thus, a single integrated well completion assembly is provided with a reduced amount of equipment, total weight of equipment, and required footspace for equipment, all without risking the possibility of the indicated contamination.

Although exemplary embodiments describe a particular integrated well completion assembly including a pump assembly at a semi-submersible rig, additional embodiments are possible. For example, a host of alternative types of rigs may be employed in addition to land based well completion assemblies. Additionally, for sake of explanation, embodiments are primarily described with reference to pump equipment including a single pump and/or prime mover. However, the pump equipment provided may actually include multiple pumps or prime movers. For example, multiple cement pumps may be coupled to multiple mud pumps or more directly to their multiple prime movers in order to provide an embodiment of a pump assembly as alluded to above. Furthermore, many changes, modifications, and substitutions may be made without departing from the scope of the described embodiments.

We claim:

1. A pump assembly for delivering mud and cement slurry to a borehole, said pump assembly comprising:

a mud pump for delivering the mud to the borehole;

a prime mover for driving said mud pump and mechanically coupled thereto;

a cement pump comprising a plunger mechanism for delivering the cement slurry to the borehole; and a hydraulic coupling line connected to the mud pump on one end and the cement pump on the other end;

wherein the hydraulic coupling line receives a pressurized fluid from the mud pump and delivers the pressurized fluid to the cement pump to act as a prime mover to reciprocate the plunger mechanism driving the cement pump, and wherein the mud is substantially isolated from the cement slurry in the pump assembly and in the borehole.

2. The pump assembly of claim 1, wherein the pump assembly is of a well completion facility, said cement pump located remotely relative to said mud pump in the facility.

3. The pump assembly of claim 1 wherein said mud pump is a first mud pump, said prime mover is a first prime mover, and said cement pump is a first cement pump, the pump assembly further comprising:

a second mud pump for delivering mud to the borehole;

a second prime mover for driving said second mud pump and coupled thereto; and a second cement pump for delivering cement slurry to the borehole and coupled to one of said second mud pump and said second prime mover for driving of said second cement pump.

4. The pump assembly of claim 1 further comprising:

a cement mixer; and a skid base, wherein the cement mixer and the cement pump are disposed on the skid base.

5. The pump assembly of claim 4 wherein said skid base is between about 5 feet long and about 15 feet long.

6. The pump assembly of claim 4 wherein said skid base is less than about 10 feet long.

7. The pump assembly of claim 6 further comprising a mud tank coupled to said mud pump for circulating the mud from the borehole to said mud pump, and wherein said mud tank includes a sifting mechanism to separate borehole cuttings from the mud.

8. The pump assembly of claim 4 wherein said cement mixer is driven by said cement pump.

9. The pump assembly of claim 1 further comprising a unitary completion control unit adapted to operate the mud pump to direct the delivering of the mud, and adapted to operate the mud pump to direct the delivering of the cement slurry.

10. The pump assembly of claim 1 wherein the pressurized fluid is delivered to the cement pump at the plunger mechanism of the cement pump and not at other portions of the pump where the cement slurry may be found.

11. An offshore well completion facility comprising:

a submersible portion for residing below water;

a platform atop said submersible portion and for residing above water; and a pump assembly secured to said platform, said pump assembly comprising:

a mud pump for directing mud to a borehole, a prime mover for driving the mud pump and coupled thereto, a cement pump comprising a plunger mechanism for directing cement slurry to the borehole, and a hydraulic coupling line connected to the mud pump on one end and the cement pump on the other end, wherein the hydraulic coupling line receives a pressurized fluid from the mud pump and delivers the pressurized fluid to the cement pump to act as a prime mover to reciprocate the plunger mechanism driving the cement pump, and wherein the mud is substantially isolated from the cement slurry in the pump assembly and in the borehole.

12. The offshore well completion facility of claim 11 wherein the cement pump is coupled to the mud pump in a manner that increases available footspace on said platform as compared to a system as provided in FIG. 1.

13. The offshore well completion facility of claim 11 wherein the cement pump is coupled to the mud pump in a manner that reduces total equipment weight at the offshore well completion facility as compared to a system as provided in FIG. 1.

14. The offshore well completion facility of claim 11 wherein the facility is one of a semi-submersible rig, a jack-up rig, and a barge rig.

15. The offshore well completion facility of claim 11 further comprising:

a tower secured to said platform;

a marine riser pipe for lowering below said tower; and a borehole casing for advancing through said riser pipe and into the borehole.

16. The offshore well completion facility of claim 15 further comprising a drilling pipe terminating in a bit for lowering into said borehole casing, drilling the borehole, and carrying mud thereto.

17. The offshore well completion facility of claim 15 further comprising:

a plug for sealing off a terminal end of said borehole casing; and a cementing pipe for lowering into said borehole casing and piercing said plug for carrying the cement slurry to the borehole.

18. The offshore well completion facility of claim 11 further comprising a unitary completion control unit adapted to operate the mud pump to direct the delivering of the mud, and adapted to operate the mud pump to direct the delivering of the cement slurry.

19. The offshore well completion facility of claim 11 wherein the pressurized fluid is delivered to the cement pump at the plunger mechanism of the cement pump and not at other portions of the pump where the cement slurry may be found.

20. A method of delivering mud and cement slurry to a borehole, the method comprising:

activating a prime mover to drive a mud pump coupled thereto;

employing the mud pump to direct the mud to the borehole;

operating a unitary completion control unit to drive a cement pump comprising a plunger mechanism with the mud pump through a hydraulic coupling line connected to the mud pump on one end and the cement pump on the other end, wherein the hydraulic coupling line receives pressurized fluid from the mud pump and delivers the pressurized fluid to the cement pump, and wherein the pressurized fluid acts as a prime mover to reciprocate the plunger mechanism to drive the cement pump;

operating the unitary completion control unit to drive the mud pump at a predetermined pressure to direct the cement slurry to the borehole; and maintaining substantial isolation of the mud from the cement slurry between said employing of the mud pump and said employing of the cement pump and in the borehole.

21. The method of claim 20 wherein the mud is directed to the borehole through a drilling pipe, the method further comprising rotating a bit at a terminal end of the drilling pipe to increase a depth of the borehole.

22. The method of claim 21 further comprising:

removing mud and cuttings from the borehole and to a mud tank;

separating the cuttings from the mud; and circulating mud from the mud tank to the mud pump.

23. The method of claim 21 wherein the borehole is lined with a borehole casing, the method further comprising:

retracting the drilling pipe from the borehole; and positioning a plug at a terminal end of the borehole casing for sealing off the borehole casing.

24. The method of claim 23 further comprising piercing the plug with a cementing pipe, the cementing pipe to carry the cement slurry to the borehole for cementing of the borehole casing thereto.

25. The method of claim 20 wherein the pressurized fluid is delivered to the cement pump at the plunger mechanism of the cement pump and not at other portions of the pump where the cement slurry may be found.

* * * * *